US011609060B1

(12) United States Patent
Carson et al.

(10) Patent No.: US 11,609,060 B1
(45) Date of Patent: Mar. 21, 2023

(54) ATTENUATING BLAST CONE

(71) Applicant: U.S. Government as Represented by the Secretary of the Army, Dover, NJ (US)

(72) Inventors: Robert Carson, Watervliet, NY (US); David Marshall, Ballston Lake, NY (US); Emanuel Tortorici, Schenectady, NY (US); Francesco Tropiano, Cohoes, NY (US); Christopher Aiello, Delmar, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 34 days.

(21) Appl. No.: 17/406,145

(22) Filed: Aug. 19, 2021

Related U.S. Application Data

(60) Provisional application No. 63/068,161, filed on Aug. 20, 2020.

(51) Int. Cl.
*F41A 21/32* (2006.01)
*F41A 21/30* (2006.01)
*F41C 9/08* (2006.01)

(52) U.S. Cl.
CPC ..... *F41A 21/30* (2013.01); *F41A 21/32* (2013.01); *F41C 9/08* (2013.01)

(58) Field of Classification Search
CPC .... F41F 1/06; F41C 9/08; F41A 21/30; F41A 21/32; F41A 21/325
See application file for complete search history.

(56) References Cited

U.S. PATENT DOCUMENTS

| | | | | |
|---|---|---|---|---|
| 2006/0156804 | A1* | 7/2006 | Shipman | F41A 21/32 73/167 |
| 2006/0288854 | A1* | 12/2006 | Witherell | F41A 21/20 89/14.05 |
| 2016/0265863 | A1* | 9/2016 | Lincoln | F41F 1/06 |

FOREIGN PATENT DOCUMENTS

| | | | | |
|---|---|---|---|---|
| EP | 1837618 | A1 * | 9/2007 | F41A 21/34 |
| EP | 1956335 | A2 * | 8/2008 | F41A 21/32 |
| GB | 2555579 | A * | 5/2018 | F41A 21/30 |
| WO | WO-9308439 | A1 * | 4/1993 | F41A 21/30 |
| WO | WO-2007064442 | A2 * | 6/2007 | F41A 23/08 |
| WO | WO-2016160308 | A1 * | 10/2016 | F41A 21/02 |
| WO | WO-2018078320 | A1 * | 5/2018 | F41A 21/30 |

* cited by examiner

*Primary Examiner* — Jonathan C Weber
(74) *Attorney, Agent, or Firm* — John P. DiScala

(57) ABSTRACT

A blast attenuator for blast overpressure has features that allow for blast attenuation and ease of projectile loading from the muzzle of the weapon system. This combination of physical ease of use and blast reduction allows the system to achieve high levels of performance without making significant concessions to operator safety.

6 Claims, 5 Drawing Sheets

ATTENUATING BLAST CONE

CROSS-REFERENCE TO RELATED APPLICATIONS

This application claims the benefit under 35 USC § 119(e) of U.S. provisional patent application 63/068,161 filed on Aug. 20, 2020.

STATEMENT OF GOVERNMENT INTEREST

The inventions described herein may be manufactured, used and licensed by or for the United States Government.

FIELD OF THE INVENTION

The invention relates in general to armaments and in particular to blast attenuators for weapon tubes.

BACKGROUND OF THE INVENTION

When high pressure propellant gases are ejected from a cannon muzzle, they displace the ambient air around the muzzle thereby forming a blast wave. This negative effect of this displaced gas is called blast overpressure (BOP) and at its peak, can reach decibel values well beyond safe limits. High BOP levels may have severe adverse effect on the crew including significant hearing damage and damage to other body organs. Accordingly, many military organizations limit the amount and intensity of BOP exposure. For example, the U.S. Department of Defense uses the MIL-STD-1474E standard to determine the level of BOP that poses a danger and the permissible exposure levels of BOP per day.

Past solutions to mitigate BOP effects involved projecting high pressure gas flow forward of the weapon. However, in existing designs the length of the attenuator is a severe drawback. Current attenuators are not acceptable for use on multiple systems due to the length of the attenuator. In particular, these approaches are not suitable for weapon systems in which projectiles are loaded from the muzzle end, as in mortar weapon systems. The use of such attenuators in these systems presents a physical impediment to the user.

Accordingly, a need exists for an attenuator which has features that allow for blast attenuation and ease of projectile loading from the muzzle of the weapon system.

SUMMARY OF INVENTION

One aspect of the invention is a blast attenuator assembly for a muzzle loaded weapon system comprising a cone, a collar and a clamp.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A blast attenuator for blast overpressure has features that allow for blast attenuation and ease of projectile loading from the muzzle of the weapon system. This combination of physical ease of use and blast reduction allows the system to achieve high levels of performance without making significant concessions to operator safety.

The blast attenuator comprises a collar and a clamp that affix to the muzzle of a weapon system. A cone is threaded onto the collar and extends forward of the collar. Advantageously, the blast attenuator is significantly shorter than existing blast attenuators. While conventional knowledge directed that a longer length was necessary for an effective blast attenuator, the inventors discovered that by significantly increasing the angle of the nozzle (34 degrees), the length of the blast attenuator could be significantly reduced. Numerical results showed that the shorter length did not decrease the effectiveness of the blast attenuator compared to conventional blast attenuators.

The blast attenuator is described herein as being affixed to a 120 mm mortar weapon system. Accordingly, the dimensions described are for a blast attenuator sized for operation on a 120 mm mortar. However, the blast attenuator is not limited to use on a 120 mm mortar and may be scaled for other caliber mortars including 60 mm and 81 mm mortar weapons. Further, while the blast attenuator is suited for use with a mortar weapon system, it is not limited to a mortar weapon system.

Figure 1:
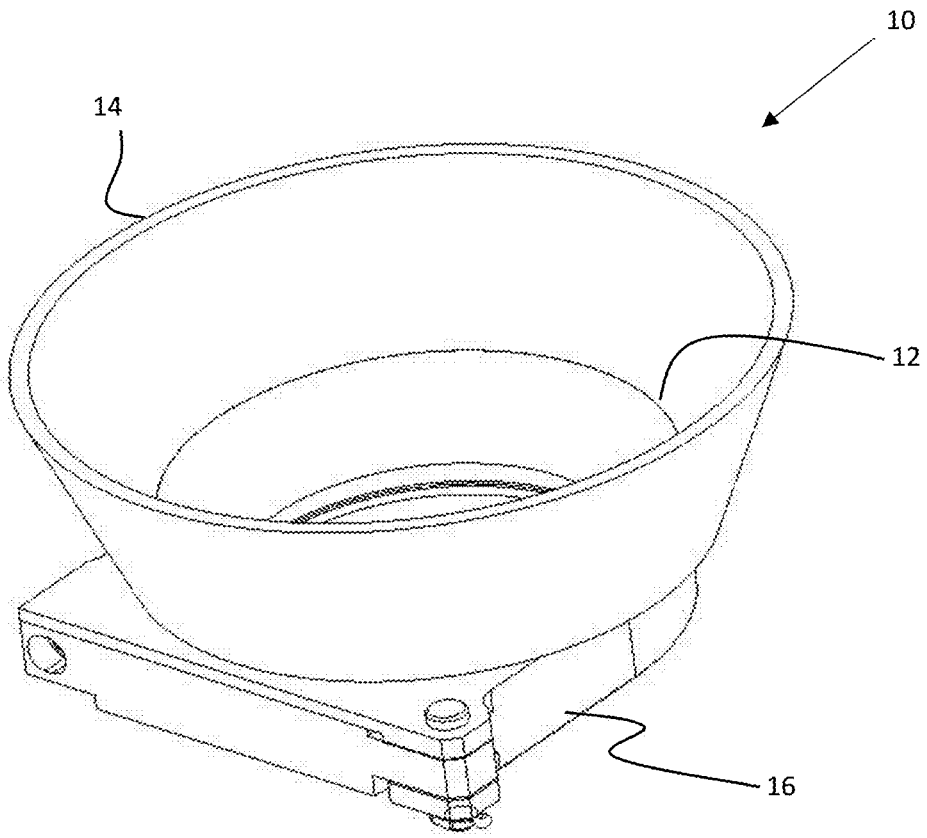
FIG. 1 is a perspective view of the assembled blast attenuator, according to an illustrative embodiment
Figure 2:
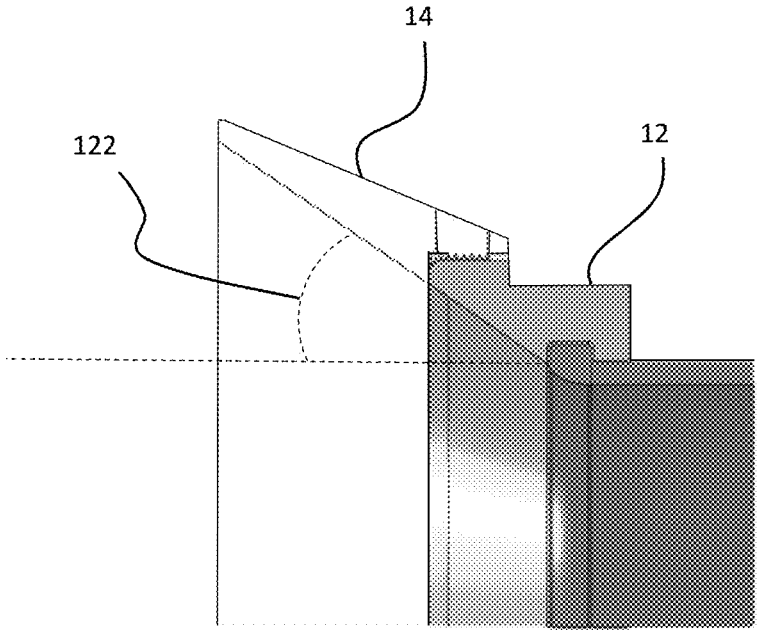
FIG. 2 is a cross-sectional view of a portion of the assembled cone and collar on the weapon system, according to an illustrative embodiment.

FIG. 1 is a perspective view of the blast attenuator, according to an illustrative embodiment. FIG. 2 is a cross-sectional view of a portion of the assembled cone and collar on the weapon system, according to an illustrative embodiment.

The blast attenuator 10 comprises a collar 12, a cone 14 and a clamp 16 that affix to the muzzle of a weapon system. The clamp 16 is affixed to the collar 12. The collar 12 threads onto the cone 14. The final assembly of the blast attenuator 10 is affixed to the muzzle of a weapon system, such as a mortar weapon system. The blast attenuator 10 slides onto the muzzle where the tube has a small lip and the clamp 16 closes to complete the assembly and adhere tightly onto the muzzle.

Figure 3:
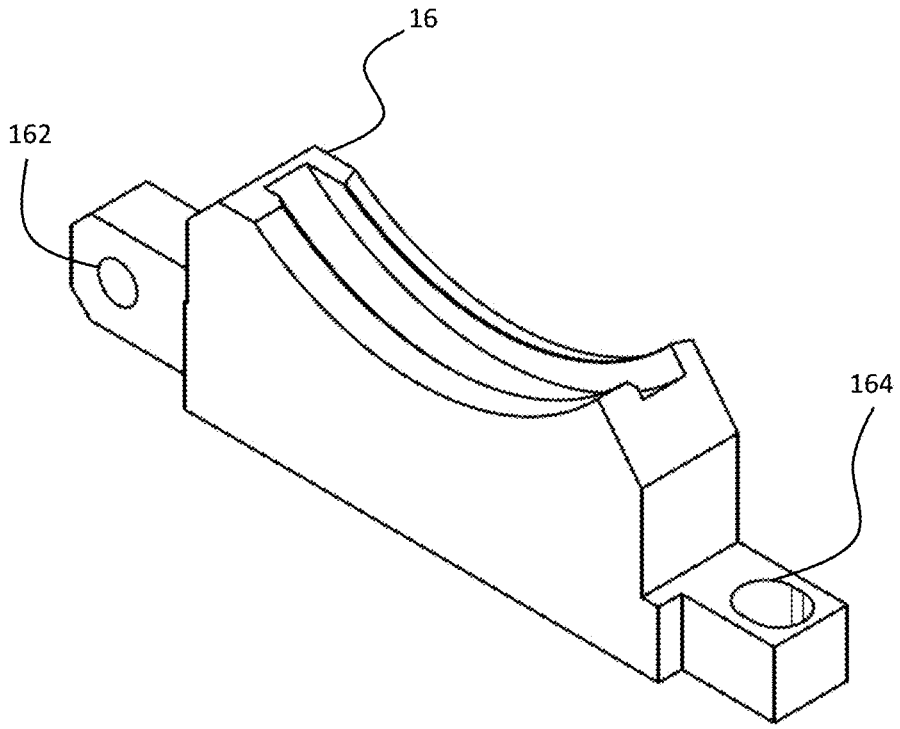
FIG. 3 is a perspective view of the clamp, according to an illustrative embodiment.

FIG. 3 is a perspective view of the clamp, according to an illustrative embodiment. The clamp 16 affixes to the collar 12 at a proximate end of the collar 12. The clamp 16 is secured to the collar 12 with fasteners, such as screws, to affix the collar 12 to the breech end of the mortar tube. The collar further comprises a first opening 162 aligned axially with the collar 12 and for receiving a fastener and a second opening 164 aligned radially with the collar 12 for receiving a fastener.

Figure 4:
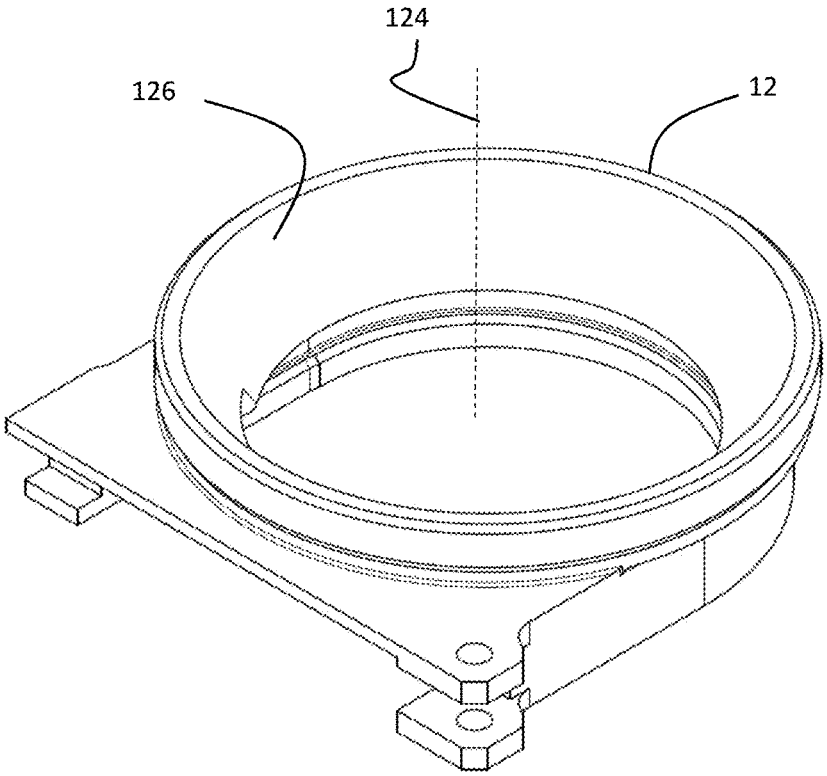
FIG. 4 is a perspective view of the collar, according to an illustrative embodiment.

FIG. 4 is a perspective view of the collar, according to an illustrative embodiment. The collar 12 is positioned on the muzzle end of the weapon such that the longitudinal axis 124 of the collar 12 is aligned with the longitudinal axis 124 of the mortar tube. The collar 12 comprises a divergent nozzle 126 defined by the inner diameter of the collar 12. In operation the divergent nozzle 126 is aligned with the muzzle end of the weapon such that the propellant gases expelled from the weapon system enter the divergent nozzle.

In the embodiment shown, the divergent nozzle 126 is approximately fifty (50) mm in length and diverges at an angle 122 of thirty-four (34) degrees from the muzzle face.

Figure 5:
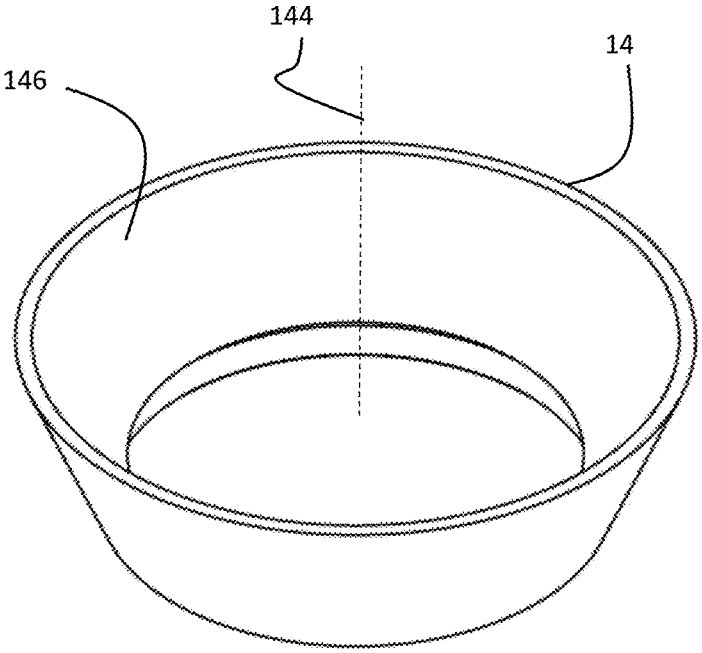
FIG. 5 is a perspective view of the cone, according to an illustrative embodiment.

FIG. 5 is a perspective view of the cone, according to an illustrative embodiment. The cone 14 is threaded onto the collar 12 such that the longitudinal axis 144 of the cone 14 is substantially aligned with the longitudinal axis 124 of the collar 12 and therefore the mortar tube. The cone 14 also comprises a divergent nozzle 146 defined by the inner diameter of the cone 14. In operation, the divergent nozzle 146 of the cone 14 is aligned with the divergent nozzle 126 of the collar 12 thereby serving as an extension of the collar 12 divergent nozzle.

The divergent nozzle 146 of the cone 14 is at an angle 122 of thirty-four (34) degrees from the muzzle face and has a length of seventy-two (72) mm.

While the invention has been described with reference to certain embodiments, numerous changes, alterations and modifications to the described embodiments are possible without departing from the spirit and scope of the invention as defined in the appended claims, and equivalents thereof

What is claimed is:

1. A blast attenuator assembly for a muzzle loaded weapon system comprising:

a collar attached to the muzzle of the muzzle loaded weapon system, said collar comprising a conical body with length of fifty millimeters and a divergent nozzle having an angle of thirty-four degrees from a central longitudinal axis and defined by an interior surface of the collar;

a cone attached to and extending forward of the collar such that the collar and the cone form a continuous divergent nozzle, said cone comprising a conical body with length of seventy-two millimeters and a divergent nozzle having an angle of thirty-four degrees from a central longitudinal axis and defined by an interior surface of the collar; and a clamp for attaching the collar to the muzzle end of the muzzle loaded weapon system.

2. The blast attenuator assembly of claim 1 wherein the muzzle loaded weapon system is a mortar weapon system.

3. The blast attenuator assembly of claim 2 wherein the mortar weapon system is a 120 mm mortar weapon system.

4. The blast attenuator assembly of claim 1 wherein the cone and the collar each further comprise corresponding threaded interfaces and the cone is screwed onto the collar.

5. The blast attenuator assembly of claim 1 wherein the clamp is affixed to the collar with a first screw oriented axially to the collar and a second screw oriented radially to the collar.

6. A blast attenuator assembly for a 120 millimeter mortar weapon system comprising:

a collar attached to a muzzle of the 120 millimeter mortar weapon system, said collar comprising a conical body with length of fifty millimeters and a divergent nozzle having an angle of thirty-four degrees from a central longitudinal axis and defined by an interior surface of the collar;

a cone screwed onto and extending forward of the collar such that the collar and the cone form a continuous divergent nozzle, said cone comprising a conical body with length of seventy-two millimeters and a divergent nozzle having an angle of thirty-four degrees from a central longitudinal axis and defined by an interior surface of the collar; and a clamp for clamping the collar to the muzzle end of the muzzle loaded weapon system, said clamp further comprising a first opening for receiving a threaded screw oriented axially to the collar and a second opening for receiving a threaded screw oriented radially to the collar.

* * * * *